US005549254A

United States Patent [19]

Menegatto

[11] Patent Number: 5,549,254

[45] Date of Patent: Aug. 27, 1996

[54] DEVICE FOR CUTTING YARN WHEN INSERTING YARN ON A YARN-HOLDER COP IN AUTOMATED WINDING APPARATUS

[75] Inventor: Carlo Menegatto, Monza, Italy

[73] Assignee: Menegatto S.r.l., Milan, Italy

[21] Appl. No.: 363,523

[22] Filed: Dec. 23, 1994

[30] Foreign Application Priority Data

Dec. 24, 1993 [IT] Italy ..... MI93A2733

[51] Int. Cl.[6] ..... B65H 54/71; B65H 54/00; B65H 75/28

[52] U.S. Cl. ..... 242/19; 242/18 PW; 242/125.1

[58] Field of Search ..... 242/125.1, 18 PW, 242/18 A, 335 A, 19, 125

[56] References Cited

U.S. PATENT DOCUMENTS

| | | | |
|---|---|---|---|
| 3,097,804 | 7/1963 | Jackson | 242/19 |
| 3,165,275 | 1/1965 | Furst . | |
| 3,899,140 | 8/1975 | Gleyze | 242/18 PW |
| 3,942,731 | 3/1976 | Lattion . | |
| 3,974,972 | 8/1976 | Egli et al. | 242/18 PW |
| 4,057,196 | 11/1977 | Amos | 242/18 PW |
| 4,154,409 | 5/1979 | Reisser et al. | 242/125.1 X |
| 4,322,040 | 3/1982 | Gadeix et al. | 242/18 PW |
| 4,466,575 | 8/1984 | Husges et al. | 242/18 PW |
| 4,856,722 | 8/1989 | Horsey et al. . | |
| 5,005,776 | 4/1991 | Schwarz | 242/19 X |

FOREIGN PATENT DOCUMENTS

| | | |
|---|---|---|
| 0282105 | 9/1988 | European Pat. Off. . |
| 638619 | 6/1950 | United Kingdom . |

*Primary Examiner*—Michael R. Mansen
*Attorney, Agent, or Firm*—Young & Thompson

[57] ABSTRACT

A device for inserting yarn on a yarn-holder cop in winding apparatus, of the type comprising a part for trapping and inserting yarn on the cop moving between a backward rest position and a forward position for insertion of the yarn on the yarn-holder cop. For cutting a lower branch of yarn, there is provided a cutting part having a first and a second cutting element moving one in respect of the other for cutting the yarn. Structure is provided for trapping the lower branch of the yarn and for driving the cutting part which can be actuated and are actuated mechanically by the yarn insertion part. The yarn cutting part is arranged near the yarn-holder cop at the point of insertion of the yarn by the yarn insertion part.

3 Claims, 3 Drawing Sheets

DEVICE FOR CUTTING YARN WHEN INSERTING YARN ON A YARN-HOLDER COP IN AUTOMATED WINDING APPARATUS

FIELD OF THE INVENTION

The present invention relates to a device for the insertion of yarn on a yarn-holder cop in automatic winding apparatus. It relates more particularly to an improvement of means for cutting a damaging part of yarn. The yarn insertion device comprises a part suitable for trapping a yarn and for inserting it on the rotating winding cop of the same, which moves between a normal backward rest position and a forward position for insertion of the yarn on the cop, and means for cutting the yarn.

BACKGROUND OF THE INVENTION

Devices for automatically inserting yarn on a cop for winding a package of yarn are already known. In them the part for trapping and inserting yarn generally traps the yarn by taking it at an intermediate point and draws it, bending it into two sections or branches, namely into an upper branch of good yarn for being wound on the cop and a secondary underlying branch of yarn which is not suitable for being wound on the cop.

In fact this secondary branch of yarn is wound together with the abovementioned good main branch and is damaging in that it winds around the main yarn, more particularly around the section thereof which defines the tail or reserve of yarn, tangling it and making the subsequent operation of yarn winding impossible or difficult, also due to the fact that it prevents connection of the yarn reserve to a further yarn package. The damaging secondary branch must therefore be cut before it is drawn by rotation of the cop together with the good yarn to be wound.

In known yarn insertion devices, the problem of cutting the damaging branch of yarn has already been tackled, but has not been solved satisfactorily as the parts used for cutting the yarn have been provided far from the reel so that there was always a certain length of covering yarn which hindered to a certain extent the winding phase and also due to the fact that occurrence of the cutting action was not always ensured therein.

In fact in some known devices the parts for cutting the damaging branch of yarn are actuated by means of systems with a pneumatic or electromagnetic drive, so that a fault in such a drive system may involve failure to cut the damaging branch of yarn with subsequent tangling of the yarn being wound which leads to rejection of the package of yarn.

Moreover, in other known devices, the parts for cutting the yarn are in the form of individual blades whereon the branch of yarn to be scrapped is rested and cut due to slight resting pressure and the considerable sharpness of the cutting blade. These types of cutting devices, although they are simple, inexpensive and do not depend on pneumatic or electromagnetic drive means for their action, have the disadvantage that, the yarn cutting blade being very sharp and easily accessible to staff in charge, the latter risk injury with a certain facility. They therefore represent a hazard for the physical safety of the staff concerned.

The object of the present invention is that of providing a device for insertion of yarn on a yarn-holder cop in automatic winding apparatus, wherein cutting means are provided to act more safely and efficiently than was the case with traditional devices.

Another object of the present invention is that of providing a device for the insertion of yarn on a reel wherein the cutting parts do not represent a risk for the physical safety of staff.

A further object of the present invention is that of providing a device of the type referred above which has a simple structure and low manufacturing cost.

SUMMARY OF THE INVENTION

The previous objects are achieved substantially by a structure of a device for the insertion of a yarn on a yarn-holder cop in automatic winding apparatus of the type comprising a part for trapping and inserting the yarn on the cop moving between a backward rest position and a forward position, near said yarn-holder cop for insertion of yarn on said yarn-holder cop, with said yarn which has an upper branch suitable for being wound on the cop itself and a lower branch, which is damaging for winding on the cop and to be eliminated, and comprising means for cutting said lower branch of yarn, in which said means for cutting the lower branch of yarn comprise a cutting part comprising a first and a second cutting elements moving one in respect of the other for cutting the yarn, means for trapping the lower branch of the yarn and means for driving said cutting part which can be actuated and are actuated mechanically by said yarn insertion part; and in which said yarn cutting part is arranged near said yarn-holder cop at the point of insertion of the yarn by said yarn insertion part.

The fact of providing said cutting part close to said yarn-holder cop, in a position corresponding to that of the point of insertion of the yarn by said yarn insertion part, and which can be actuated mechanically by the latter, allows a total and safe cut, without the risk of failures, of the damaging branch of said yarn.

BRIEF DESCRIPTION OF DRAWINGS

Further features and advantages of the present invention will be made clearer on reading the following description, relating to a preferred embodiment of the invention and to be read with reference to the accompanying drawings, in which.

DESCRIPTION OF THE PREFERRED EMBODIMENT OF THE INVENTION

Figure 1:
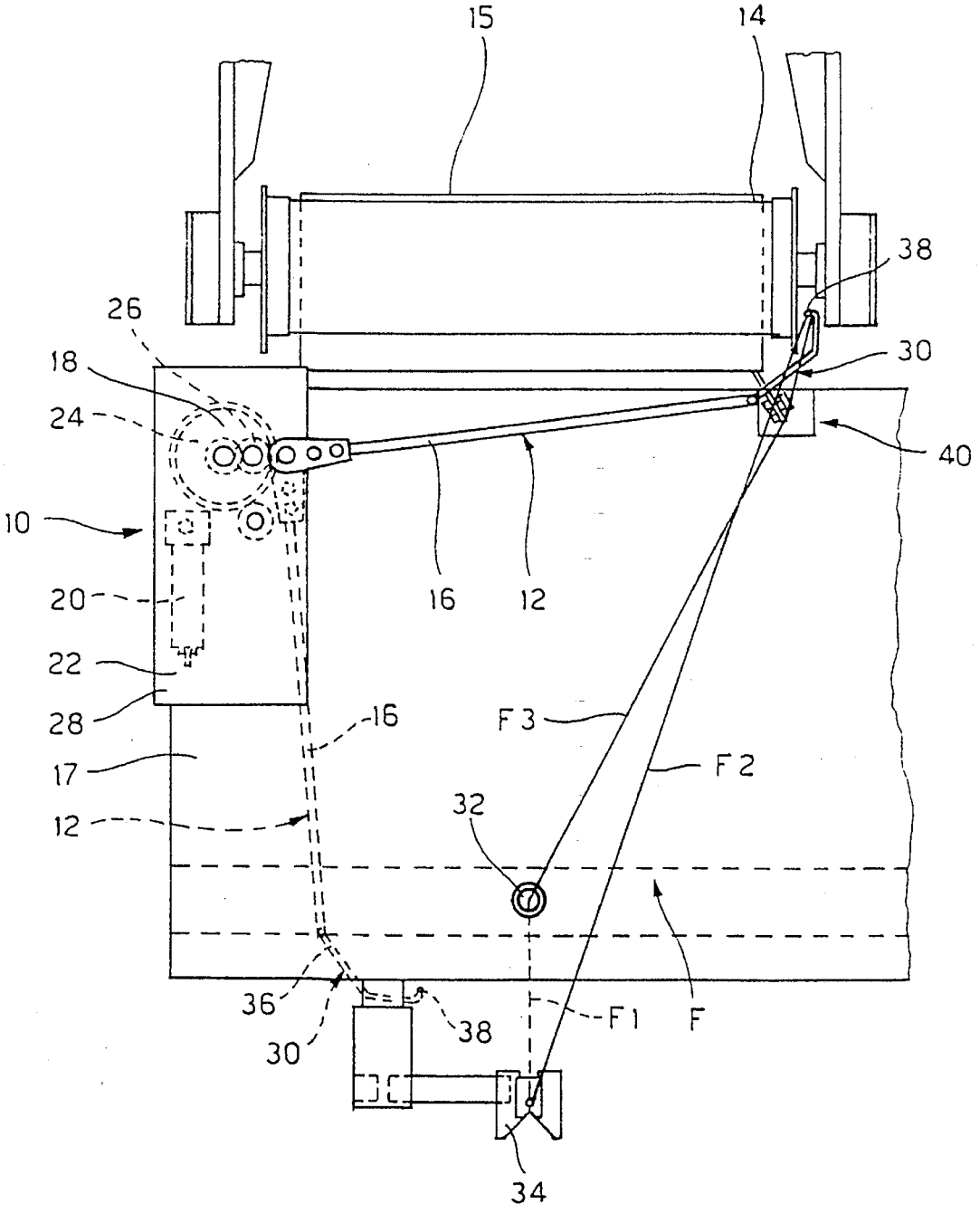
FIG. 1 represents a view from above of a winding machine holding the device for insertion of yarn on the yarn-holder cop according to the present invention.
Figure 2:
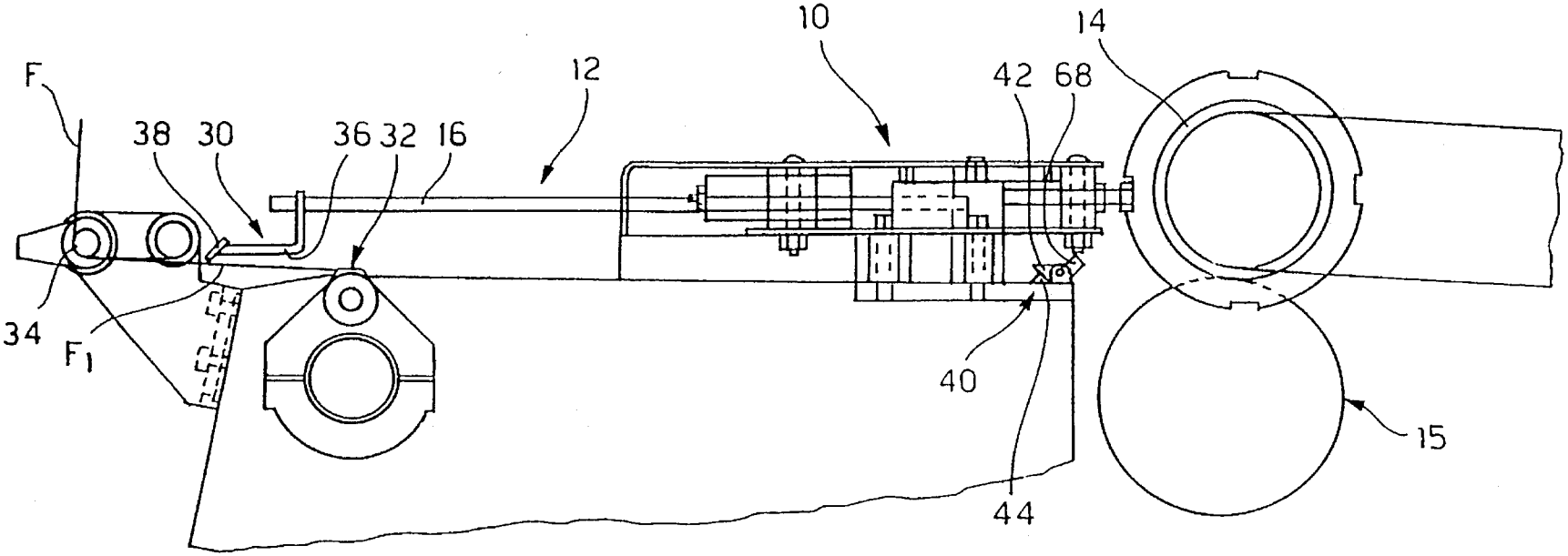
FIG. 2 is a side view of the yarn winding machine of FIG. 1.

FIGS. 1 and 2 show a device 10 for the automatic insertion of a yarn on a reel-holder cop in textile winding apparatus. Said device comprises a part 12 for trapping and inserting yarn F on the rotating cop 14 driven in rotation by a contact roll 15, which, as shown clearly by the figures, moves between a backward rest position, shown by a dotted line in FIG. 1 and an unbroken line in FIG. 2, and a forward yarn insertion position, shown by an unbroken line in FIG. 1.

In the embodiment shown, the device for trapping and inserting the yarn comprises a rod 16, hinged at 18 to the bench 17 of the winding machine, which is driven to rotate by a pneumatic actuator 20, attached in a position beneath the bench 17 of the winding machine 22, by means of a cogged wheel 24 which drives the rotation of a further cogged wheel 26 directly connected to the rod 16 of the part for trapping and inserting the yarn 12.

More particularly, as shown in the figures, the rod 16 is attached to the bench 17 of the textile machine by means of a plate 28, below which are attached the gears 24, 26 and the aforementioned actuator 20 for the transmission and drive of the rotation movement of said part for trapping and inserting yarn, in such a way that the system forms a compact block which can be attached easily to the bench of the winding machine.

For trapping and inserting yarn on the collection cop 14, said part 12 comprises, on the side opposite to the one of hinging, a shaped arm 30 in an elastic material suitable for intercepting said yarn, as will be explained in greater detail hereinbelow, and drawing it towards and against said collection cop 14 which, due to the fact that it is driven to rotate, traps it and starts to wind it on its lateral collection surface.

As shown in FIGS. 1 and 2, the winding machine to which the device of the invention is attached is fitted with a device for the suction of the yarn 32 which, in such working conditions, aspirates the yarn coming from the guide 34 to prevent it from reaching the winding zone of the same. In the aforementioned phases the yarn, which is maintained continuously fed towards the winding machine, only runs in the section between the guide device 34 and the suction device 32, with a branch of yarn shown by the dotted line in FIG. 1 and unbroken line in FIG. 2 and denoted by F1 in both figures.

The yarn interception arm has a lower main portion 36, substantially horizontal and attached by one of its ends to said rod 16 in a position below it. At the opposite end to the one of attachment to the rod 16, the arm 30 has a portion 38 which is arranged obliquely in order to interfere with the yarn F1 mentioned above, as shown clearly in FIG 2.

The rotation drive of the rod 16 causes interception by the portion 38 of said arm 30 of the yarn F1 and draws it towards and against said cop 14 at one of the lateral edges of the cop, namely the one arranged on the side opposite to the one occupied by the base plate 28 of the trapping and insertion part 12 in order to start winding of a reserve yarn.

It is completely clear from the figures that in this phase of trapping the intercepted yarn F1 is bent and divided into two further branches F2 and F3, of which the first is between the guide 34 and the branch 38 of the trapping arm and the other between the latter and the yarn suction device 32. In this phase of trapping and drawing the yarn towards the collection cop 14, the part of the yarn which has been aspirated inside the suction device 32 is also drawn outwards. The latter is damaging yarn as it is tangled, that is to say in conditions unsuitable for being wound, and moreover as it would create the winding of a double yarn.

Due to the lower position of the suction mouth in relation to the yarn guide 34, the damaging yarn F3 is positioned below the yarn F2.

According to the invention the virtually complete cutting of this damaging yarn F3 is actuated by means of a cutting part 40 arranged near said yarn-holder cop 14 at the point of insertion of the yarn by the insertion part 12.

Figure 3:
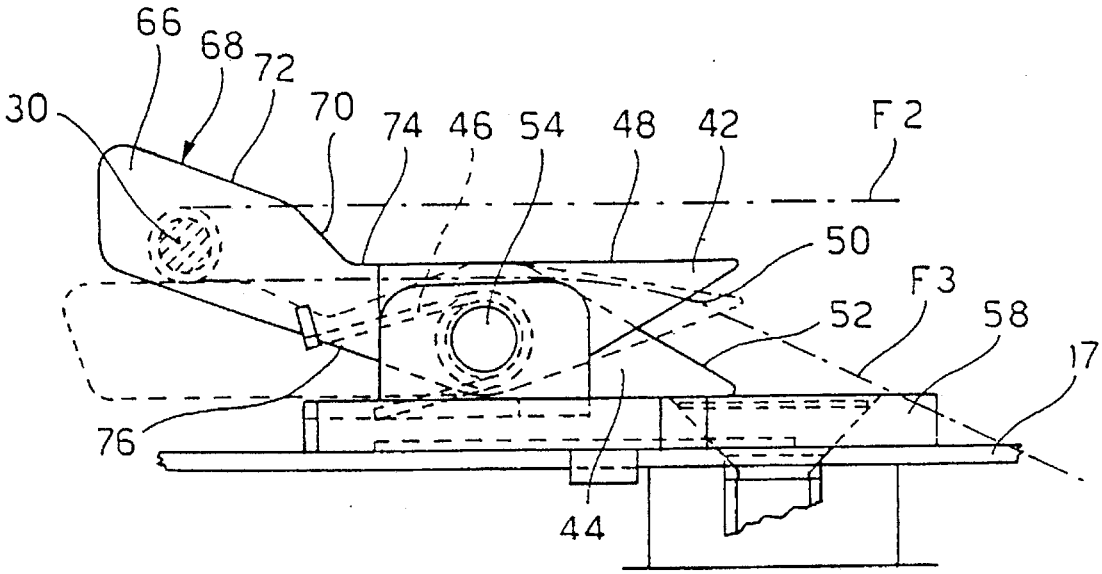
FIG. 3 represents a side view of the yarn cutting part of the yarn insertion device according to the present invention.
Figure 4:
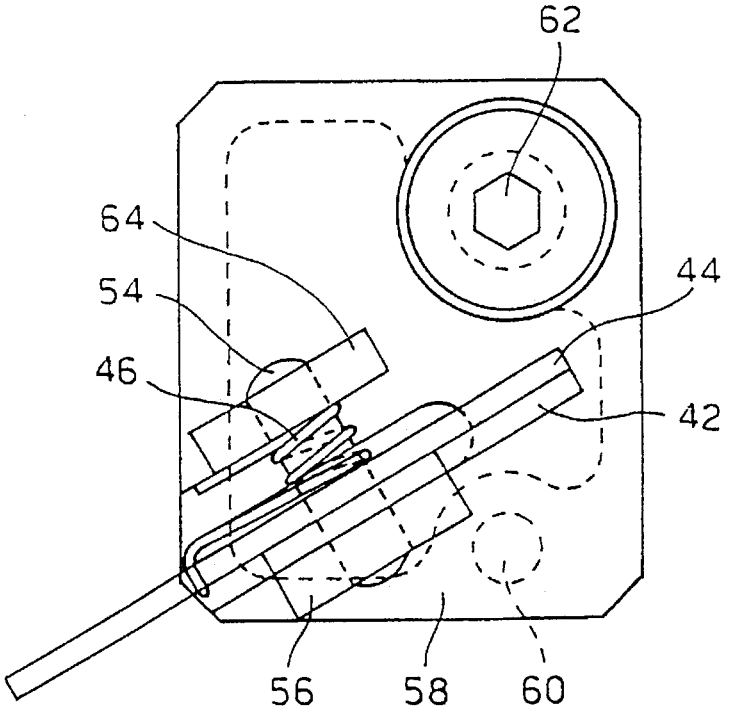
FIG. 4 represents a view from above of the cutting part of FIG. 3.

As is clearer by referring to FIGS. 3 and 4, said cutting part is in the form of a scissor-type device which extends towards the yarn to be cut and has a first fixed cutting element 42 in an upper position and a second mobile cutting element 44 in a lower position, with the two cutting elements 42 and 44 pushed in a normally open position by means of the torsion spring 46.

Said fixed cutting element 42 has a substantially flat upper surface 48 arranged horizontally to allow, above it, a virtually grazing passage of said insertion part and lower tilted cutting edge 50 designed to trap and restrain the yarn F2 to be cut.

As is clear from FIG. 1, the cutting elements of the scissor cutting device are in fact arranged so that the cutting elements are positioned obliquely in relation to the yarn to be cut F3, and are oriented in such a way as to receive said yarn between the respective cutting edges 50, 52.

Said upper fixed element 42 therefore performs the function of trapping, by means of its cutting edge 50, the lower branch of yarn while awaiting, as shown by the dotted line in FIG. 3, for the lower cutting element to rise and bring its tilted cutting edge 52 towards the aforementioned cutting edge 50 of the cutting element 42.

As is clear from FIGS. 3 and 4, the two cutting elements 42, 44 of the scissor cutting part are kept adjacent by means of a pin 54 around which said mobile cutting element 52 rotates, the latter being attached to a bracket 56 integral with a plinth 58 which has holes 60, 62 for inserting suitable screws for fastening to the bench of the textile machine.

On the side opposite to the one occupied by the bracket 56, a second bracket 64 is provided whereto one end of the torsion return spring 46 is attached, the latter comprising a central cylindrical spiral portion which winds around the pin 54 and whose other end is integral with the lower rear edge of said mobile cutting element 42.

According to the invention, advantageously, said cutting scissor element is actuated mechanically and directly by said yarn trapping and insertion element 12. This therefore avoids the use of all those pneumatic or electromagnetic actuation devices which do not ensure the same reliability of intervention of a direct mechanical actuation device as is however provided by the present invention. These pneumatic and electromechanical actuation devices and the like, as referred previously, may break down more easily than a purely mechanical device, or the energy supply for them, be it in the form of electricity or in the form of a pressurised fluid, may be cut off, involving in both cases failure to perform the cut and jeopardising the winding of the yarn.

Advantageously, the present invention provides, for the actuation of said lower mobile cutting element 44, that the latter extends on the side opposite the one of arrival of said trapping and insertion part 12 with a tilted arm 66 which, in a normal rest condition, extends upwards beyond the upper horizontal surface 48 of said fixed element 42 and has an upper face 68 suitable for being hit by said arm 30 for intercepting the yarn of said trapping and insertion part 12, as shown in FIG. 1.

Said upper face 68 has a first tilted portion having a first, more tilted, section 70, suitable for receiving the blow of the trapping and insertion part 12 and a second section 72 to the rear of said section 70 which has a more gentle incline in order to allow easier sliding of the same.

Said upper face 68 also has, upstream of the striking portion, a portion 74 which in the rest condition of the cutting device is arranged horizontally on the extension of said horizontal surface 48 of said fixed cutting element 42.

A lower edge 76 of said actuation arm 66 is shaped in such a way that it hits, when the mobile element 44 is actuated for cutting, against a lower surface of said plinth 58 and stops the scissor closure of said lower mobile cutting element.

Thus a device has been provided for the insertion of yarn on a collection cop in rotating motion capable of cutting completely and safely a branch of yarn which is damaging for winding on the reel. The fact of providing a cutting device wherein the cutting elements face one another and are opposite one to the other also means that there are no uncovered, easily accessible and dangerous blades.

It is obviously clear that what has been written and shown in the accompanying drawings with reference to the preferred embodiment of the present invention has been given purely by way of a non-limiting example of the inventive principle claimed.

What is claimed is:

1. A yarn winding apparatus comprising a frame, means for supporting a yarn-holding cop on the frame, and means supported by the frame for inserting a yarn on a yarn-holding cop on the frame, said inserting means comprising a member mounted on the frame for movement relative to the frame in a path disposed in a plane, means retaining a length of yarn extending from a yarn supply, in such a position that when said member moves toward a said cop, said member will contact said length of yarn and draw said yarn out in a loop having two branches only one of which is to be attached to a said cop, and cutting means adjacent said cop-supporting means for cutting said branch which is not to be attached to the cop, said cutting means comprising stationary and movable cutting elements that define between them a recess for receiving yarn to be cut, said recess opening in a direction parallel to said plane, resilient means acting between said elements to maintain said recess open, said movable cutting element having a portion disposed in said plane when said recess is open and being engaged by said member when said member moves toward said cop thereby to cut yarn in said branch which is not to be attached to the cop.

2. A yarn winding apparatus as claimed in claim 1, in which said cutting elements are mounted for relative pivotal movement and have coacting cutting edges that open and close with a scissors movement.

3. A yarn winding apparatus as claimed in claim 1, and means for releasably retaining a free end of said yarn until after said insertion means has inserted said yarn on a said cop and said yarn has been cut.

* * * * *